US006691446B2

(12) United States Patent
Graves

(10) Patent No.: US 6,691,446 B2
(45) Date of Patent: Feb. 17, 2004

(54) RIFLE BARREL CLEANING, RETRIEVAL TOOL

(76) Inventor: Barry L. Graves, 2061 Flint Hill Rd., Powhatan, VA (US) 23139

( * ) Notice: Subject to any disclaimer, the term of this patent is extended or adjusted under 35 U.S.C. 154(b) by 0 days.

(21) Appl. No.: 10/173,788

(22) Filed: Jun. 19, 2002

(65) Prior Publication Data

US 2003/0233779 A1 Dec. 25, 2003

(51) Int. Cl.[7] ..... F41A 29/02; B08B 9/02
(52) U.S. Cl. ..... 42/95; 15/104.16
(58) Field of Search ..... 42/90, 95; 15/104.16

(56) References Cited

U.S. PATENT DOCUMENTS

| | | | | | |
|---|---|---|---|---|---|
| 684,981 | A | * | 10/1901 | Drummond et al. | 15/104.19 |
| 1,450,037 | A | * | 3/1923 | Heiman | 15/104.16 |
| 1,560,322 | A | | 11/1925 | Roberts | |
| 1,786,520 | A | * | 12/1930 | Darling | 15/104.19 |
| 2,798,238 | A | * | 7/1957 | Rogovin | 15/104.16 |
| 2,805,434 | A | * | 9/1957 | Hopkins | 15/104.16 |
| 3,137,957 | A | | 6/1964 | Ingalls | |
| 4,222,142 | A | | 9/1980 | DiProspero | |
| 4,776,125 | A | | 10/1988 | Black | |
| 4,901,465 | A | | 2/1990 | Hsu | |
| 4,930,240 | A | | 6/1990 | Bice | |
| 4,975,001 | A | * | 12/1990 | Rabo et al. | 408/82 |
| 5,379,542 | A | * | 1/1995 | Guzman | 42/95 |
| 5,557,871 | A | | 9/1996 | LaLonde | |
| 5,588,242 | A | | 12/1996 | Hughes | |
| 5,628,136 | A | | 5/1997 | Wickser, Jr. | |
| 5,651,207 | A | * | 7/1997 | Knight | 42/95 |
| 5,775,021 | A | | 7/1998 | Weiss | |
| 6,085,376 | A | * | 7/2000 | Antal et al. | 15/104.061 |
| 6,088,866 | A | | 7/2000 | Hedge | |
| 6,378,236 | B1 | * | 4/2002 | Solberg et al. | 42/95 |

FOREIGN PATENT DOCUMENTS

| | | | | |
|---|---|---|---|---|
| EP | 0698423 | A1 * | 2/1996 | B08B/9/04 |

* cited by examiner

*Primary Examiner*—Charles T. Jordan
*Assistant Examiner*—John W. Zerr
(74) *Attorney, Agent, or Firm*—Richard C. Litman

(57) ABSTRACT

A debris retaining and retrieval tool for cleaning the barrels of rifles. A serrated brass cutting blade is positioned between two spaced plastic guide discs and further between a plastic lead-in guide element and a plastic follower guide element. The elements are combined by a bolt and nut and fastened to a ram rod. The spaced guide discs and the cutting blade entrap the scraped barrel residue of powder, plastic and lead to be carried outside the cleaned barrel for removal by a toothbrush.

18 Claims, 4 Drawing Sheets

RIFLE BARREL CLEANING, RETRIEVAL TOOL

BACKGROUND OF THE INVENTION

1. Field of the Invention

The present invention relates generally to rifles. More specifically, the invention is a tool used to remove and store in the tool the residue which remains within the rifling grooves of rifled barrels that utilize rifling to stabilize a projectile.

2. Description of the Related Art

The relevant art of interest describes various cleaning devices for rifles, but none discloses the present invention. There is a need for a tool which can clean the rifling grooves and store in the tool the debris of powder, plastic and lead residue removed from a rifle's barrel. The relevant art will be discussed in the order of perceived relevance to the present invention. The following patents featuring gun cleaning devices all lack the serrated cutter blade and a DELRIN® (a registered trademark of E.I. DuPont de Nemours and Co. identifying a synthetic resinous plastic material in the form of powders for further use in the industrial arts) disc arrangement of the instant invention.

U.S. Pat. No. 4,901,465 issued on Feb. 20, 1990, to Chung-Ching Hsu describes a rifle gun barrel cleaner device kit comprising a capped casing containing a two-piece cleaning rod and a connecting sleeve, a set of 3 cylindrical different diameter cloth wipers, and a set of 3 different diameter wire brushes, wherein the casing is used as a handle. The cleaning procedure is conventional with the wire brushes to scrape the inside of the barrel and cleaned with an oiled cloth.

U.S. Pat. No. 4,930,240 issued on Jun. 5, 1990, to Kenneth R. Bice describes a combination gun barrel cleaning and bullet extracting device added to a battery driven screwdriver comprising three connecting driving parts (driving head, shaft and an extension shaft) for a specific spiral pitched metallic bristle array. The brush can be substituted with a slotted attachment for cloth wipers or a bullet extracting spiral coned head.

U.S. Pat. No. 5,628,136 issued on May 13, 1997, to Robert L. Wickser, Jr. describes a gun cleaning and safety device stored and transported in a gun barrel comprising a locking extendable ramrod which accommodates a ramrod tip, a first connecting slip rod, a second connecting rod, a rod seat, a bottle container for storing oil and/or cleaning solvent, a compression spring, a pin, and a cartridge-like end piece.

U.S. Pat. No. 6,088,866 issued on Jul. 18, 2000, to Bruce F. Hedge describes a gun barrel and tube cleaning device comprising a metal brush enclosed within a tubular sheath made of woven fabric having exposed brush bristles and foam inserts (some of which have gun cleaning solvent which are doubled to create bulges) is pulled through the gun barrel.

U.S. Pat. No. 5,775,021 issued on Jul. 7, 1998, to Michael J. Weiss describes a collapsible cleaning rod for rifle barrels having six connected aluminum tubular segments connected by a stainless steel cable to an aluminum handle. The tubular segments can also be made of polycarbonate, nylon or polypropylene. The cleaning tips can have a patch loop and wire bristles or a fabric cleaning plug.

U.S. Pat. No. 4,222,142 issued on Sep. 16, 1980, to Peter DiProspero describes a tip for a gun cleaning rod having a threaded end for attaching to a cleaning rod, and a rag receiving loop on the opposite end. Bristles are provided between the two ends having a sleeve for allowing the bristles to diverge outwardly.

U.S. Pat. No. 4,776,125 issued on Oct. 11, 1988, to Vernon A. Black describes a portable ram rod device for cleaning gun barrels. The device is a belt-worn spool containing a wound cable and a removable patch holder or a brush.

U.S. Pat. No. 5,557,871 issued on Sep. 24, 1996, to Anthony F. LaLonde describes metal and nylon bristles combined on a brush for cleaning a gun barrel bore. The metal bristles are phosphor bronze. The nylon bristles are colored in accordance with a color code to provide identification of the size required to clean a specific caliber bore. The brush includes loops of varying size for attaching a cleaning cloth.

U.S. Pat. No. 5,588,242 issued on Dec. 31, 1996, to Jeffrey T. Hughes describes a plastic gun barrel cleaning kit comprising a nylon cleaning rod having a threadable end for attaching wire brushes and a cleaning cloth holder or cleaning jag. Cloth patches, an adapter and a wire fitting are provided in a case.

U.S. Pat. No. 3,137,957 issued on Jun. 23, 1964, to Bradford W. Ingalls describes a device stored in the barrel having a braided steel cable having a head to seat in the cartridge head recess with a wire brush on one end, and an apertured hardened steel tip on the opposite end for providing a padlock.

U.S. Pat. No. 1,560,322 issued on Nov. 3, 1925, to William F. Roberts describes a rifle barrel and sight protector device comprising a substantially U-shaped element having one leg with a wire brush for closing a gun muzzle, and one leg of leather to protect a gun sight.

None of the above inventions and patents, taken either singularly or in combination, is seen to describe the instant invention as claimed. Thus, a retrieval tool for cleaning rifle barrels solving the aforementioned problems is desired.

SUMMARY OF THE INVENTION

The present invention is a tool head attached to a rifle cleaning rod and is used to remove the residue which remains within the rifling grooves in a rifle's barrel after it has been discharged. The tool performs a scraping action within the rifling grooves. The tool's self-centering, free-moving action tracks the rifling grooves as it follows the rifle's rate of twist. Any powder, plastic and lead residues removed are collected, stored and retrieved in the open mediate tool areas as the tool is removed. The tool includes (1) a toothed brass blade that matches the barrel's grooves and does not contact the bore or lands, (2) two plastic cylindrical guides having two grooves each on either side of a disc component that protects the bore and centers the brass blade, (3) and stainless steel fasteners that insure that the tool is virtually rustproof and maintenance free. The brass blade can be readily replaced when worn. The residue removed by the blade, is removed with the tool which can be cleaned with a toothbrush.

The retriever tool is a unique device in it's ability to not only clean the rifling of a weapon, but to remove the residue that has been cleaned as it exits the barrel's bore. The collection and storage of residue, within the retrieval tool, means that the residue normally forced to the bottom of the rifle barrel has been removed. This unique attribute prevents residue from fouling the breach area which can cause a misfire.

Normal cleaning procedures can still leave residue buildup in the corners of the rifling grooves. Brushes will not completely clean in these areas leaving residue to build onto itself. The use of the retrieval tool, for muzzle loading black powder rifles, has a three-fold benefit. Use the retrieval tool between shots to remove the powder, plastic and lead residue that remains in the rifling grooves after a weapon has been fired.

1. By removing the powder, plastic and lead residue the rifling is cleaned to a pre-fired condition.
2. This makes the loading from shot to shot smooth and consistent. The pressure to force the projectile down the bore and seat it on the powder charge is now repeatable.
3. The pressure that is exerted when the powder charge is ignited will also be consistent and repeatable.

The loading procedure is the most important consideration in it's relationship to accuracy. When a rifle is fired and the residue has not been thoroughly removed, the pressure to load increases from shot to shot. This makes loading more difficult as the resistance intensifies. As the loading pressure increases so does the pressure when the powder charge is ignited. This rise in pressure causes the projectile to have an increase of feet per second of velocity. As the velocity changes so does the point of impact. Accuracy is lost due to an incorrectly loaded weapon via an improperly cleaned weapon.

The use of the retrieval tool promotes easy and consistent loading of black powder rifles. The use of the retrieval tool prevents powder, plastic and lead residue from falling into the breach area which can cause blockage from the nipple to the powder charge, causing misfires.

The use of the retrieval tool between shots promotes and insures rifle accuracy by removing the residue in the rifling grooves and makes the loading and shooting pressure consistent from shot to shot. By using the retrieval tool between shots to remove the residue from the rifling grooves the final cleanup for the day will be the last shot.

The retrieval tool gets into the rifling grooves as no other cleaning tool has done until now. The exact fit to the rifling grooves matches the rifle manufacture's tolerances and ensures a precision fit in the rifle's barrel which it has been designed for. The part of the retrieval tool that removes the residue is a blade made from brass. The tool's brass blade matches the rifling and fits it like a key. The blade will not enter the rifle barrel until it has been properly aligned. When the alignment is made the tool drops into the rifling and tracks it's rate of twist. The retriever's blade follows the rifling grooves and never comes in contact with the rifle's bore. As the retriever exits the barrel, the rifle has been cleaned to it's original unfired condition and will repeat the accuracy of a consistent loading and firing weapon.

For use in modern rifled weaponry the retriever will decrease cleaning time for the sportsman and the soldier alike. By attaining a clean weapon in less time a soldier or artillery group can be back on line or in action with minimal down time for cleaning that weapon, aiding in the response time for the soldier or artillery group.

Using the retriever in modern rifled weaponry will aid in preventing residue from falling into the breach area, thus decreasing the overall time spent cleaning the breach and related parts.

The use of the retriever will aid and promote confidence that the weapon has been cleaned thoroughly and that it's accuracy has been retrieved and retained.

Accordingly, it is a principal object of the invention to provide a rifle barrel cleaning tool device which captures the scraped residue.

It is another object of the invention to provide a rifle barrel cleaning tool device attachable to a cleaning rod.

It is a further object of the invention to provide a rifle barrel cleaning tool head device having a plastic cylindrical body with a brass cutter disc positioned between two plastic disc guides.

Still another object of the invention is to provide a rifle barrel cleaning tool head device having a dismantleable two-piece body enabling the replacement of a worn brass cutter disc mounted on a cleaning rod handle by a socket head cap screw.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
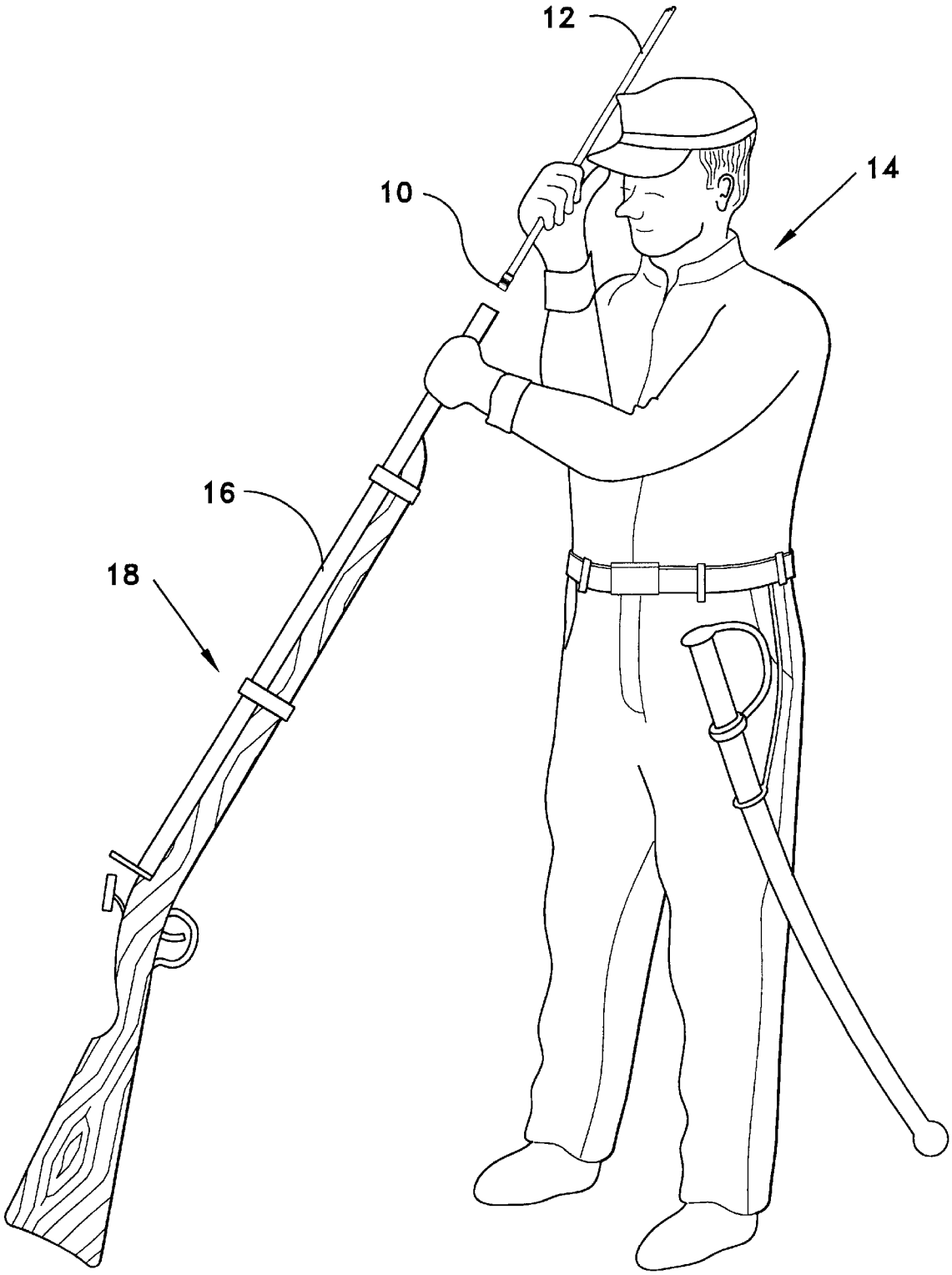
FIG. 1 is an environmental, perspective view of a man using the retrieval cleaning tool for a muzzle loading black powder rifle according to the present invention.

The present invention is depicted in FIG. 1 and directed to a debris retrieval tool 10 at the end of a ramrod 12 utilized by a soldier 14 for cleaning the rifle barrel 16 of a rifle 18. The cleaned debris of powder, plastic and lead residue is kept in the tool 10 and removed by a toothbrush (not shown) after several passes until no residue is collected by the tool 10.

Figure 2:
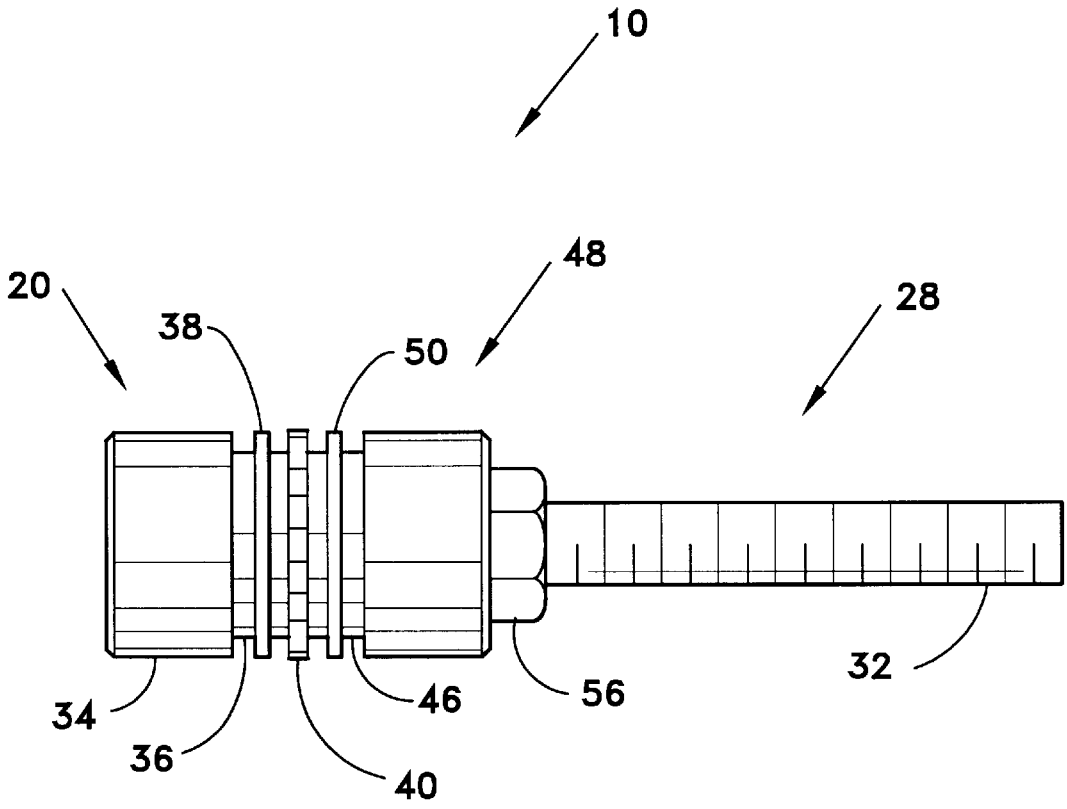
FIG. 2 is a side elevational view of the tool without the handle rod.
Figure 3:
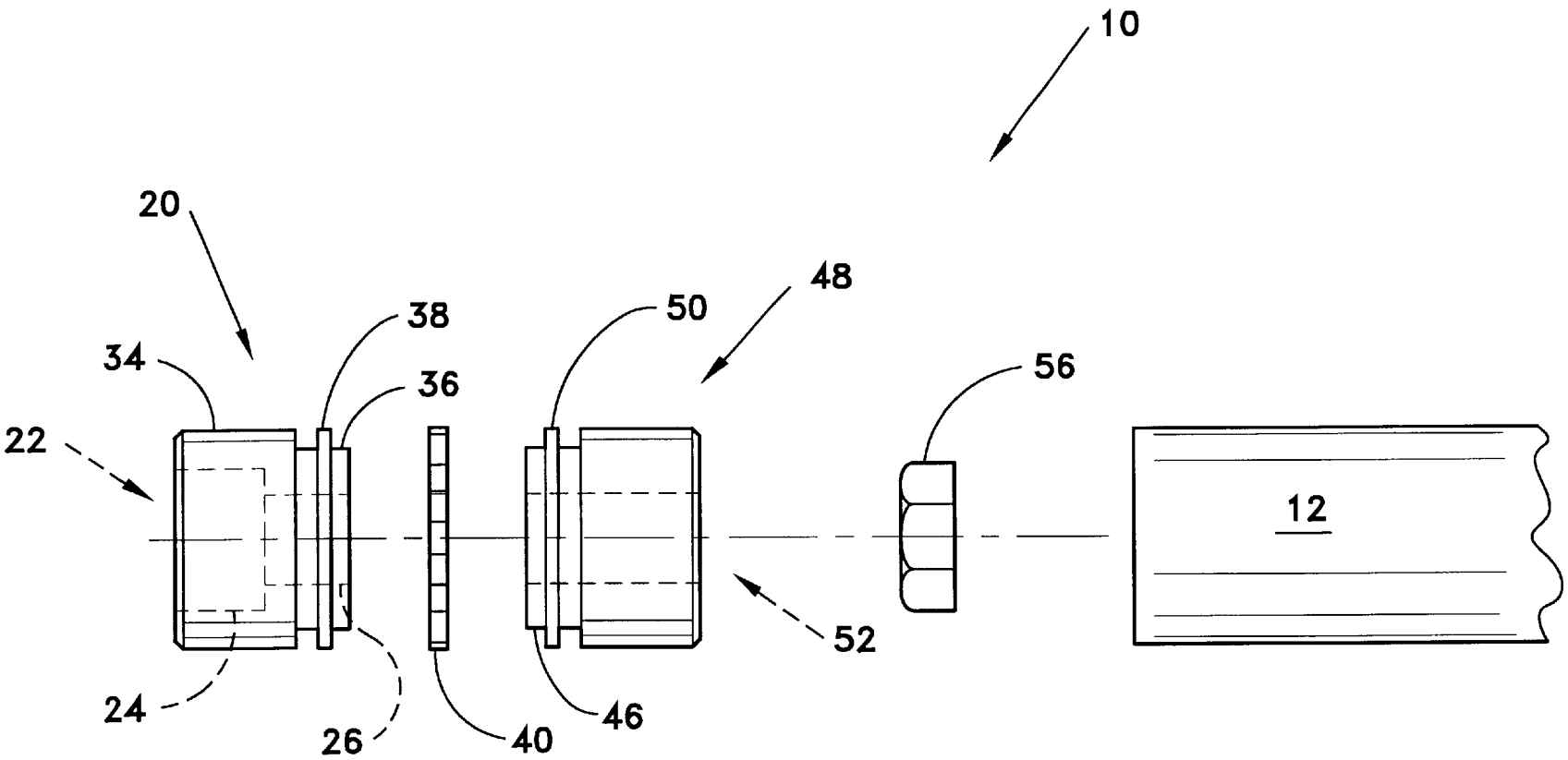
FIG. 3 is an exploded side elevational view of the FIG. 2 tool showing the throughbore in shadow lines.
Figure 4:
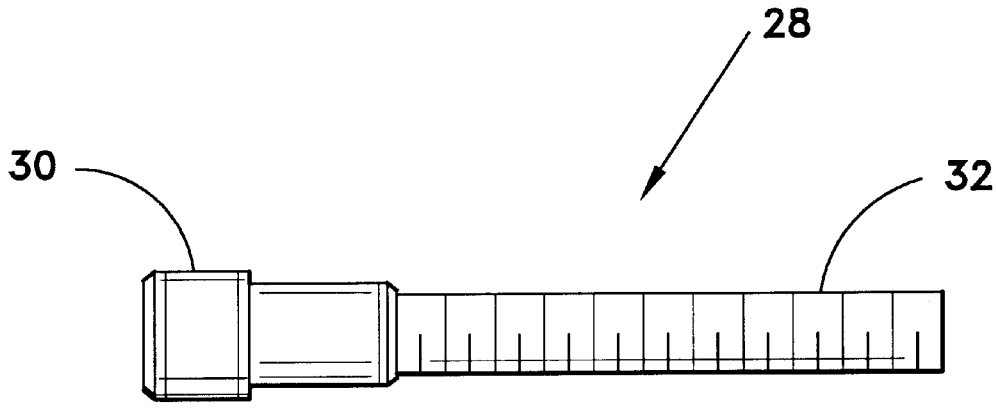
FIG. 4 is a side elevational view of the socket head bolt for attaching the tool to a conventional handle rod.

In FIG. 2 and 3, the tool 10 is shown enlarged and having a longitudinal axis. A cylindrical white DELRIN® lead-in guide element 20 having a centered throughbore 22 with a large diameter aperture 24 and a reduced diameter aperture 26 for accepting the fastening socket head cap screw 28 with its enlarged circular cap 30 and threaded stem 32 (FIG. 4). The lead-in guide element 20 has an enlarged head portion 34 and a stem portion 36 which supports the first circular plastic guide disc 38 made of white DELRIN® on the stem portion 36.

Figure 5:
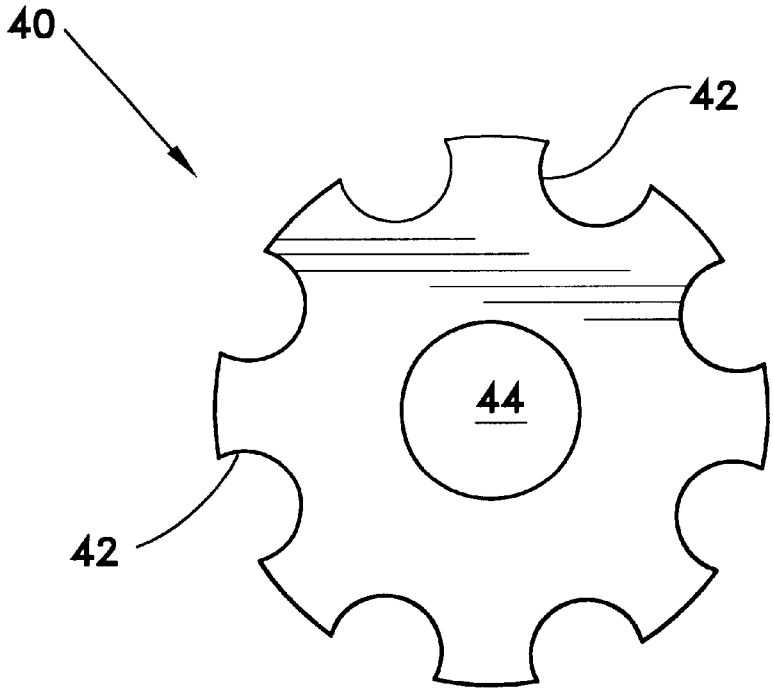
FIG. 5 is a front elevational view of a serrated brass cutting disc inserted between two body parts.

A brass circular cutting blade 40 having an array of eight peripheral, and semicircular valleys 42 spaced 28.5° (FIG. 5). The perimeter profile of the blade is cut to match the rifling and bore diameter of any specific weapon to leave a clearance of 0.001 to 0.002 inch. The valley portions 42 of the cutting blade clear the rifling lands allowing only the groove alignment portion to make contact with the barrel's bore. The cutting blade 40 is placed by its aperture 44 on the threaded stem 32 of the cap screw 28 adjacent the stem portion 36 of the lead-in guide element 20 to abut the stem portion 46 of the follower guide element 48 made of white DELRIN® which also has a second circular guide disc 50 spaced from the cutting blade 40. The follower guide element 48 has only one aperture diameter 52 (FIG. 3) to fit the stem 32 of the cap screw 28. Thus, the aggregation by the cap screw 28 of the lead-in guide element 20, the first guide disc 38, the cutting blade 40, the second guide disc 50, and the follower guide element 48 constitutes the tool 10 to be essentially attached to a ramrod 12.

FIG. 3 further illustrates the hexagonal locknut with nylock insert (an insert made of synthetic material) 56 required to fixedly connect the tool 10 via the cap screw 28 to the ramrod 12.

Exemplary dimensions for a specific tool 10 will be as follows for a rifle bore size of 0.50 calibre:

Socket head cap screw 28: 10-32 UNC, 18-8 stainless steel; 1.25 in. length; cap 0.31 in. diameter, 0.19 deep; and threaded stem 0.19 in. diameter.

Lead-in guide element 20: White DELRIN®; 0.38 in. length; 0.50 in. outside diameter; large diameter throughbore 24 0.32 in. diameter and 0.20 in. deep; reduced diameter throughbore 26 0.20 in. diameter and 0.18 in. deep; and stem portion 36 0.40 outside diameter and 0.12 in. length.

Follower guide element 48: White DELRIN®; 0.44 in. length; 0.50 in. outside diameter; stem portion 46 0.40 outside diameter and 0.12 length; and throughbore 52 diameter 0.20 in.

Guide discs 38, 50: White DELRIN®; outside diameter 0.50 in.; 0.032 in. thick; and formed by machining the stem portions 36, 46.

Cutting blade 40: 260 half-hard brass; outside diameter 0.51 in. and aperture 44 0.20 in; 0.040 in. thick; and 8 cutting semicircular valleys 42.

Hexagonal locknut 56: 10-32 UNC, 18-8 stainless steel with nylock insert; but a 300 series stainless steel locknuts to be used for military applications.

It should be noted that the dimensions of the tool will vary for each different bore size and rifling grooves.

It is to be understood that the present invention is not limited to the embodiment described above, but encompasses any and all embodiments within the scope of the following claims.

I claim:

1. A debris retrieval tool for cleaning rifle barrels comprising:

a tool having a longitudinal axis;

a cylindrical plastic lead-in guide element having a head portion, a stem portion and a centered throughbore;

a circular plastic guide disc positioned integrally on said stem portion;

a circular metal cutting blade having a centered aperture; a cylindrical plastic follower guide element having a stem portion, a head portion and a centered throughbore;

a circular plastic guide disc positioned on said stem portion of the follower guide element; and a socket head cap screw passing through the throughbores of the lead-in guide element and the follower guide element aligned along the longitudinal axis to abut and secure the cutting blade and each guide element;

whereby the retrieval tool collects the debris scraped inside rifling grooves of the rifle barrel for a controlled disposal.

2. The debris retrieval tool according to claim 1, wherein a cylindrical elongated handle is attached to the follower guide element by the cap screw.

3. The debris retrieval tool according to claim 2, wherein a hexagonal locknut is affixed to the cap screw to maintain the aggregation of all parts at a tension that allows free-moving, self-centering operation.

4. The debris retrieval tool according to claim 1, wherein the socket head cap screw has a circular head and a threaded shaft.

5. The debris retrieval tool according to claim 4, wherein the lead-in element has an enlarged circular aperture to accommodate the socket head of the cap screw and a reduced throughbore for the cap screw's shaft.

6. The debris retrieval tool according to claim 1, wherein the lead-in element and the follower guide element have a reduced diameter stem portion to secure the cutting blade between the lead-in element and the follower guide element.

7. The debris retrieval tool according to claim 1, wherein the guide discs are separated by a predetermined equal space from the cutting blade.

8. The debris retrieval tool according to claim 1, wherein the cutting blade has a peripheral spaced array of rifle barrel conforming semicircular valleys.

9. The debris retrieval tool according to claim 8, wherein the cutting blade is made of brass.

10. The debris retrieval tool according to claim 1, wherein the tool is made of substantially white plastic.

11. A debris retrieval tool for cleaning rifle barrels comprising:

a tool having a longitudinal axis;

a cylindrical lead-in guide element having a centered throughbore;

a circular metal cutting blade having a centered aperture and a peripheral spaced array of semicircular valleys;

two circular plastic guide discs positioned on either side of said metal cutting blade;

a cylindrical follower guide element having a centered throughbore; and a socket head cap screw passing through the throughbores of the lead-in guide element and the follower guide element to abut and secure the cutting blade and the two guide discs spaced between the guide elements and each guide element;

whereby the retrieval tool collects the debris scraped inside rifling grooves of rifle barrels for a controlled disposal.

12. The debris retrieval tool according to claim 11, wherein a cylindrical elongated handle is attached to the follower guide element by the cap screw.

13. The debris retrieval tool according to claim 12, wherein a hexagonal locknut is affixed to the cap screw to maintain the aggregation of all parts at a tension that allows free-moving, self-centering operation.

14. The debris retrieval tool according to claim 11, wherein the cap screw has a circular head.

15. The debris retrieval tool according to claim 11, wherein the lead-in element has an enlarged circular aperture to accommodate a head of the cap screw and a reduced throughbore for a shaft of the cap screw.

16. The debris retrieval tool according to claim 11, wherein the lead-in element and the follower guide element each have a reduced diameter stem portion to secure the cutting blade between the elements.

17. A debris retrieval tool for cleaning rifle barrels comprising:

a tool having a longitudinal axis;

a cylindrical lead-in guide element having a neck portion and a centered throughbore;

a circular metal cutting blade having a centered aperture;

two circular plastic guide discs positioned on either side of said metal cutting blade;

a cylindrical follower guide element having a neck portion and a centered throughbore;

the lead-in element and the follower guide element each support one guide disc on their neck portions; and a socket head cap screw passing through the throughbores of the lead-in guide element and the follower guide element to abut and secure the cutting blade and the two guide discs spaced between the guide elements and each guide element;

whereby the retrieval tool collects the debris scraped inside rifling grooves of rifle barrels for a controlled disposal.

18. The debris retrieval tool according to claim 17, wherein the guide discs are separated by a predetermined equal space from the cutting blade.

* * * * *